US009085984B2

(12) United States Patent
Ristau et al.

(10) Patent No.: US 9,085,984 B2
(45) Date of Patent: Jul. 21, 2015

(54) AIRFOIL

(75) Inventors: Neil Ristau, Simpsonville, SC (US); Gunnar Leif Siden, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 593 days.

(21) Appl. No.: 13/545,248

(22) Filed: Jul. 10, 2012

(65) Prior Publication Data

US 2014/0017089 A1 Jan. 16, 2014

(51) Int. Cl.
*F01D 5/14* (2006.01)

(52) U.S. Cl.
CPC ..... *F01D 5/141* (2013.01); *F05D 2240/304* (2013.01); *F05D 2250/711* (2013.01); *F05D 2250/712* (2013.01)

(58) Field of Classification Search
CPC ..... F05D 2250/71; F05D 2250/711; F05D 2250/712
USPC ..... 416/243, DIG. 3, DIG. 5
See application file for complete search history.

(56) References Cited

U.S. PATENT DOCUMENTS

| | | | | |
|---|---|---|---|---|
| 5,292,230 | A * | 3/1994 | Brown | 416/223 A |
| 6,358,012 | B1 * | 3/2002 | Staubach | 416/228 |
| 7,597,544 | B2 * | 10/2009 | Hasenjager et al. | 416/242 |
| 7,685,713 | B2 | 3/2010 | McKeever | |
| 2002/0021968 | A1 * | 2/2002 | Olhofer et al. | 416/223 R |

* cited by examiner

*Primary Examiner* — Edward Look
*Assistant Examiner* — Jason Davis
(74) *Attorney, Agent, or Firm* — Dority & Manning, PA

(57) ABSTRACT

An airfoil includes a leading edge, a trailing edge downstream from the leading edge, a pressure surface between the leading and trailing edges, and a suction surface between the leading and trailing edges and opposite the pressure surface. A first convex section on the suction surface decreases in curvature downstream from the leading edge, and a throat on the suction surface is downstream from the first convex section. A second convex section is on the suction surface downstream from the throat, and a first convex segment of the second convex section increases in curvature.

18 Claims, 5 Drawing Sheets

AIRFOIL

FEDERAL RESEARCH STATEMENT

This invention was made with Government support under Contract No. DE-FC26-05NT42643, awarded by the Department of Energy. The Government has certain rights in the invention.

FIELD OF THE INVENTION

The present disclosure generally involves an airfoil and a method for reducing shock loss in a turbine by enhancing the airfoil curvature aft of the throat.

BACKGROUND OF THE INVENTION

Turbines are widely used in a variety of aviation, industrial, and power generation applications to perform work. Each turbine generally includes alternating stages of peripherally mounted stator vanes and axially mounted rotating blades. The stator vanes may be attached to a stationary component such as a casing that surrounds the turbine, while the rotating blades may be attached to a rotor located along an axial centerline of the turbine. The stator vanes and rotating blades each have an airfoil shape, with a concave pressure side, a convex suction side, and leading and trailing edges. A working fluid, such as steam, combustion gases, or air, flows along a gas path through the turbine. The stator vanes accelerate and direct the compressed working fluid onto the subsequent stage of rotating blades to impart motion to the rotating blades, thus turning the rotor and performing work.

Various conditions may affect the maximum power output and/or efficiency of the turbine. For example, higher power levels and lower ambient temperatures increase the differential pressure of the compressed working fluid across the turbine. At higher differential pressures, the compressed working fluid may reach supersonic velocities as it passes through the turbine, creating considerable shock waves and reflected shock waves between adjacent rotating blades and corresponding shock losses at the trailing edge of the rotating blades. At a sufficient differential pressure, the shock waves become tangential to the trailing edge, creating a condition known as limit load. The strong shock now goes from the trailing edge of one airfoil to the trailing edge of the adjacent airfoil. The resultant shock waves and corresponding shock losses may limit the maximum power output of the turbine as the maximum tangential force is reached. If the pressure ratio increases beyond the limit load, a drastic increase in loss occurs. Conversely, at lower power levels, the shock reflection from the pressure side onto the suction side of the airfoil occurs farther upstream. At a sufficiently low pressure ratio, the shock reflection becomes normal, thus leading to high loss and corresponding reduction in turbine efficiency. As a result, the maximum power output of the turbine may be limited by colder ambient temperatures. Therefore, an airfoil and method for reducing shock losses and/or enhancing turbine efficiency at lower power levels would be useful.

BRIEF DESCRIPTION OF THE INVENTION

Aspects and advantages of the invention are set forth below in the following description, or may be obvious from the description, or may be learned through practice of the invention.

One embodiment of the present invention is an airfoil that includes a leading edge, a trailing edge downstream from the leading edge, a pressure surface between the leading and trailing edges, and a suction surface between the leading and trailing edges and opposite the pressure surface. A first convex section on the suction surface decreases in curvature downstream from the leading edge, and a throat on the suction surface is downstream from the first convex section. A second convex section is on the suction surface downstream from the throat, and a first convex segment of the second convex section increases in curvature.

Another embodiment of the present invention is an airfoil that includes a leading edge, a trailing edge downstream from the leading edge, a pressure surface between the leading and trailing edges, and a suction surface between the leading and trailing edges and opposite the pressure surface. A first concave section on the pressure surface increases in curvature downstream from the leading edge. A second concave section is on the pressure surface downstream from the first concave section, and a first concave segment of the second concave section increases in curvature.

The present invention may also include an airfoil having a leading edge, a trailing edge downstream from the leading edge, and a pressure surface between the leading and trailing edges. A first concave section on the pressure surface increases in curvature downstream from the leading edge. A second concave section is on the pressure surface downstream from the first concave section, and a first concave segment of the second concave section increases in curvature. A suction surface is between the leading and trailing edges and opposite the pressure surface. A first convex section on the suction surface decreases in curvature downstream from the leading edge, and a throat on the suction surface is downstream from the first convex section. A second convex section is on the suction surface downstream from the throat, and a first convex segment of the second convex section increases in curvature.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
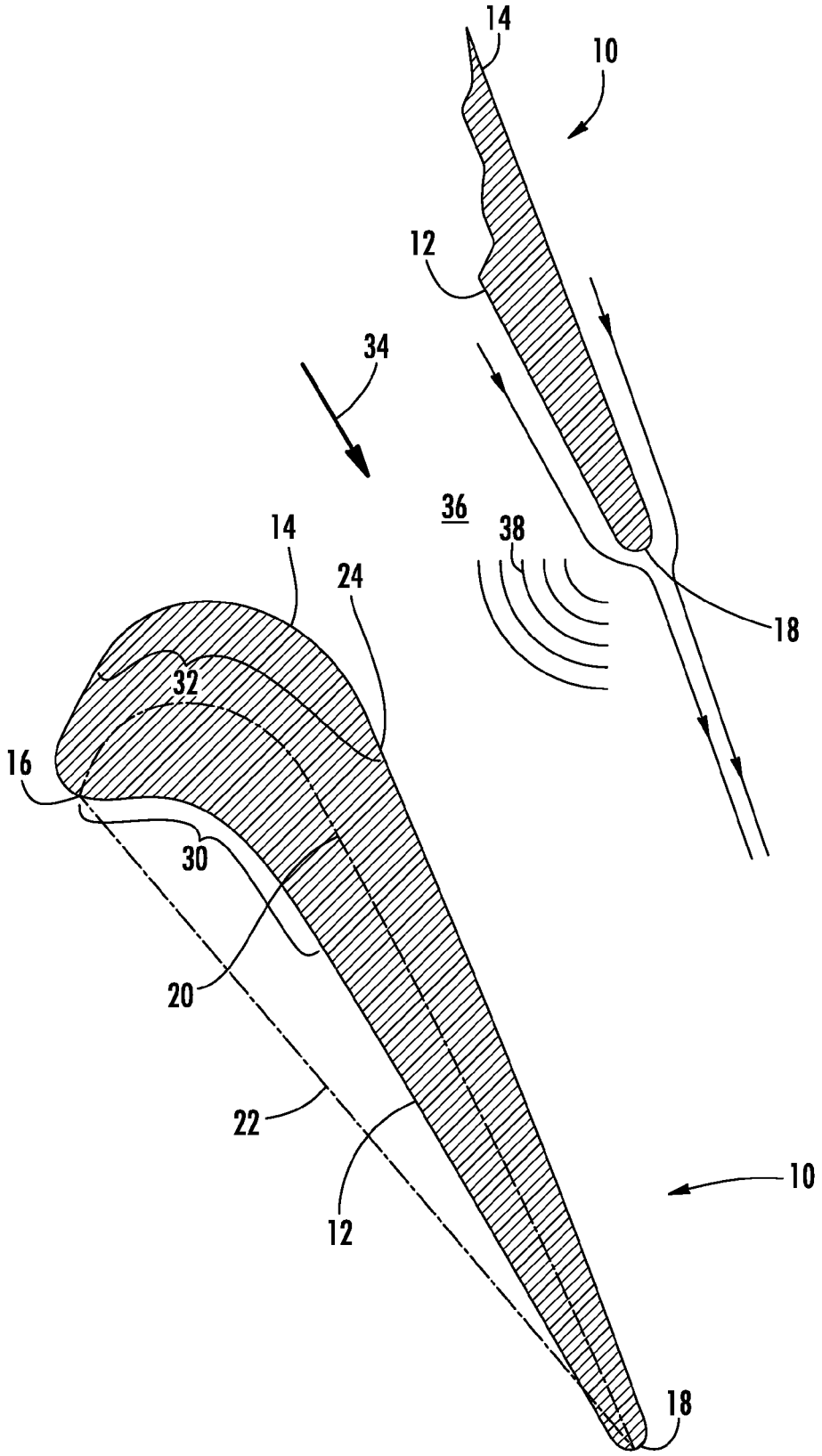
FIG. 1 is a radial cross-section view of adjacent exemplary airfoils.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include an airfoil and method for reducing shock losses in a turbine. The airfoil generally includes a leading edge, a trailing edge, and pressure and suction sides as are known in the art. However, one or both of the pressure and suction sides increase curvature proximate to the trailing edge to flatten pressure or shock waves across the airfoil. In particular embodiments, the suction side may further include an intermediate section having a curvature of zero. One of ordinary skill in the art will readily appreciate that the airfoil and methods described herein may be incorporated into any stage of any turbine, and the embodiments disclosed herein are not limited to any particular type of turbine unless specifically recited in the claims.

FIG. 1 provides a radial cross-section view of adjacent exemplary airfoils 10, such as may be incorporated into a stage of rotating blades incorporated into a steam or gas turbine. As shown, each airfoil 10 generally includes a pressure surface 12 opposed to a suction surface 14, and the pressure and suction surfaces 12, 14 meet at a leading edge 16 upstream from a trailing edge 18. Each airfoil 10 includes a mean camber line 20, a chord line 22, and a throat 24. The mean camber line 20 is midway between the pressure and suction surfaces 12, 14 as measured perpendicular to the mean camber line 20. The chord line 22 is a straight line that extends from the leading edge 16 to the trailing edge 18 and joins the ends of the mean camber line 20. The throat 24 corresponds to the point on the suction surface 14 of the airfoil 10 that is closest to the trailing edge 18 of the adjacent airfoil 10. As shown in FIG. 1, the pressure surface 12 includes a concave section 30, and the suction surface 14 includes a convex section 32. As a working fluid 34, such as steam, combustion gases, or air, flow along a gas path 36 between the adjacent airfoils 10, the working fluid 34 decreases pressure and increases velocity, creating pressure or shock waves 38 between the pressure and suction surfaces 12, 14 of adjacent airfoils 10. The shock waves 38 disrupt laminar flow across the airfoils 10 and continue downstream, increasing cycle fatigue in the downstream components.

The curvature of the concave and convex sections 30, 32 directly affects the pressure and velocity changes of the working fluid 34 flowing between the adjacent airfoils 10, as well as the associated pressure or shock waves 38. As used herein, curvature refers to the amount by which a surface deviates from being straight or flat, and curvature may be calculated as the reciprocal of the radius of the curve defined by the surface. In the exemplary airfoils 10 shown in FIG. 1, the curvature of the airfoils 10 aft or downstream from the throat 24, also referred to as the unguided turning angle, is enhanced to reduce shock strength and reflection depending on the operating point of interest.

Figure 2:
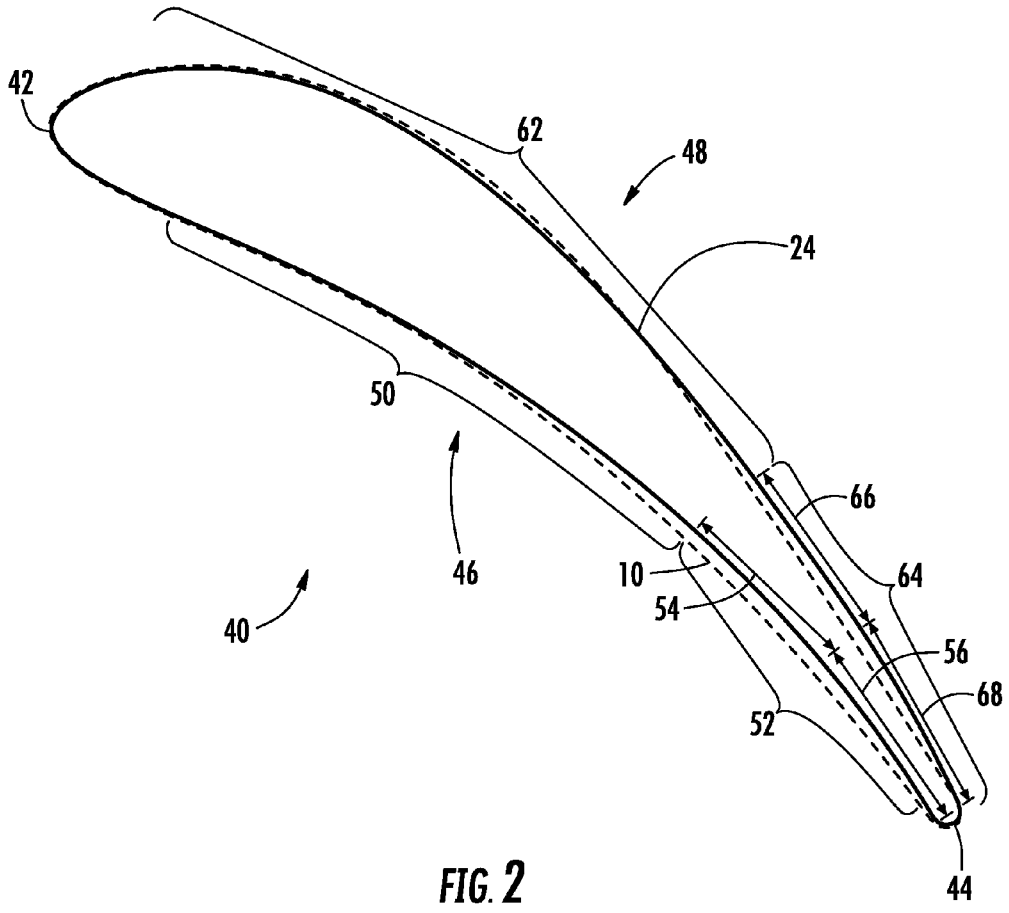
FIG. 2 is a radial cross-section view an airfoil according to a first embodiment of the present invention.
Figure 3:
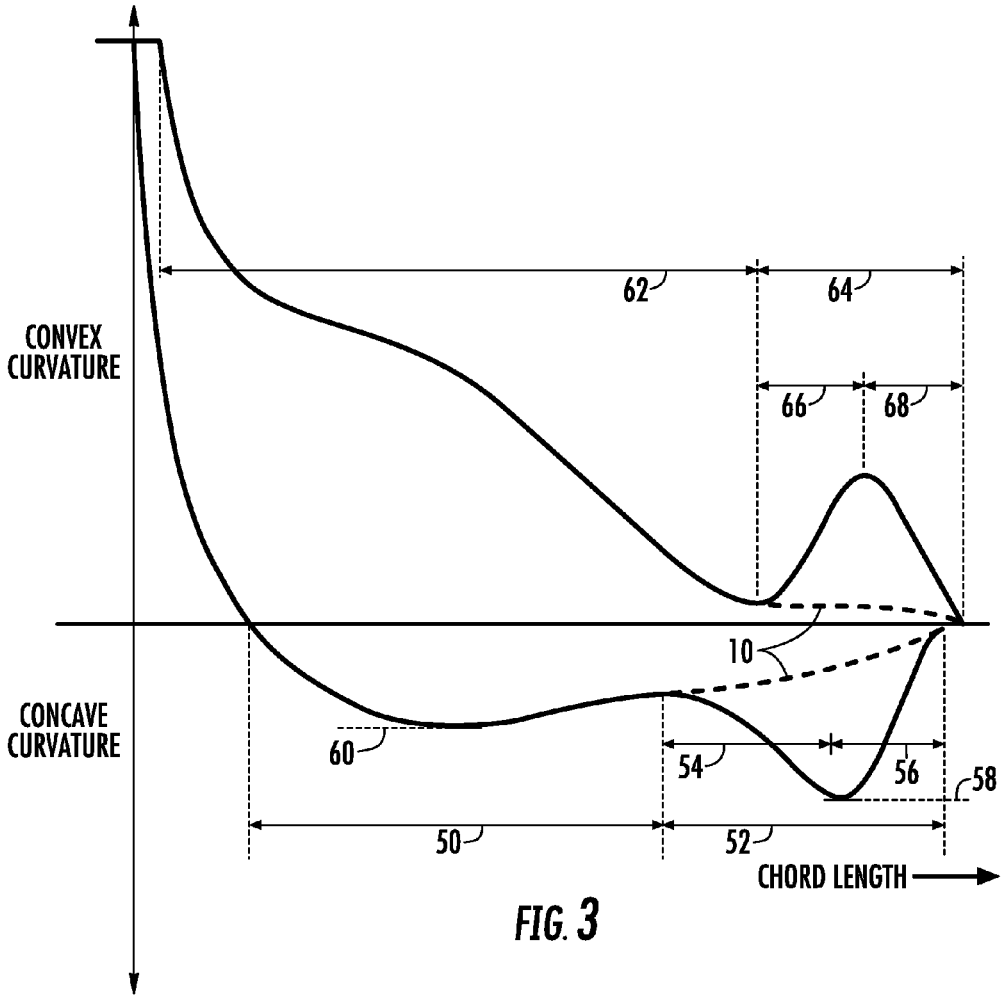
FIG. 3 is an exemplary graph of the curvature of the airfoil shown in FIG. 2.

FIG. 2 provides a radial cross-section view an airfoil 40 according to a first embodiment of the present invention, with the outline of the exemplary airfoil 10 shown in dashed lines for comparison. As shown in FIG. 2, the airfoil 40 includes a leading edge 42 and a trailing edge 44 downstream from the leading edge 42. A pressure surface 46 is opposed to a suction surface 48 between the leading and trailing edges 42, 44. FIG. 3 provides an exemplary graph of the curvature of the airfoil 40 shown in FIG. 2, with the curvature of the airfoil 10 shown in FIG. 1 shown in dashed lines. The horizontal axis in FIG. 3 represents the chord length between the leading edge 42 and the trailing edge 44, and the vertical axis represents the amount of curvature in the pressure and suction surfaces 46, 48. By convention, the area above the horizontal axis represents convex curvature, and the area below the horizontal axis represents concave curvature.

As shown in FIG. 2, the pressure surface 46 includes a first concave section 50 and a second concave section 52 downstream from the first concave section 50. Referring to FIG. 3, the first concave section 50 increases in curvature downstream from the leading edge 42, and the second concave section 52 increases in curvature downstream from the first concave section 50. In the particular embodiment shown in FIGS. 2 and 3, the second concave section 52 includes a first concave segment 54 that increases in curvature and a second concave segment 56 downstream from the first concave segment 54 that decreases in curvature. In addition, the second concave section 52 may have a larger maximum curvature 58 than the maximum curvature 60 of the first concave section 50.

Referring back to FIG. 2, the suction surface 48 includes a first convex section 62 and a second convex section 64 downstream from the first convex section 62. The first convex section 62 generally decreases in curvature downstream from the leading edge 42, and the second convex section 64 increases in curvature downstream from the first convex section 62. In the particular embodiment shown in FIGS. 2 and 3, the first convex section 62 continuously decreases in curvature downstream from the leading edge 42. In addition, the second convex section 64 includes a first convex segment 66 that increases in curvature and a second convex segment 68 downstream from the first convex segment 66 that decreases in curvature.

Figure 4:
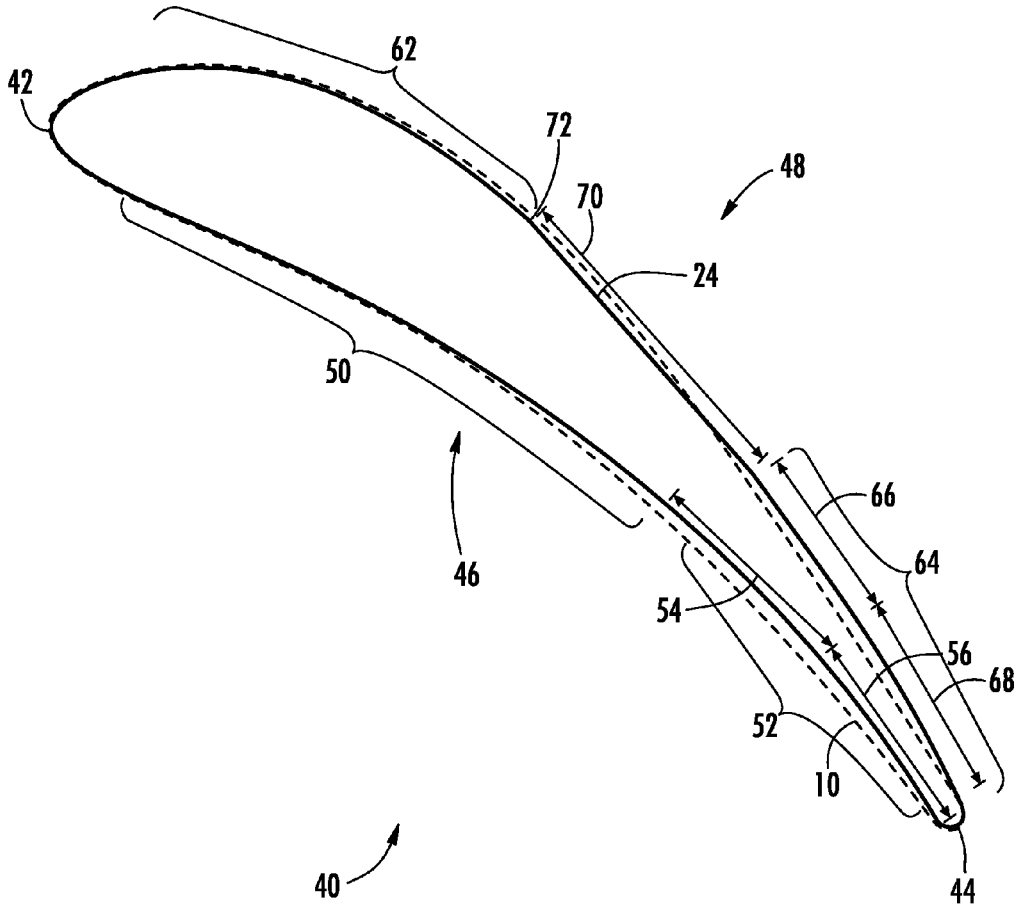
FIG. 4 is a radial cross-section view an airfoil according to a second embodiment of the present invention.
Figure 5:
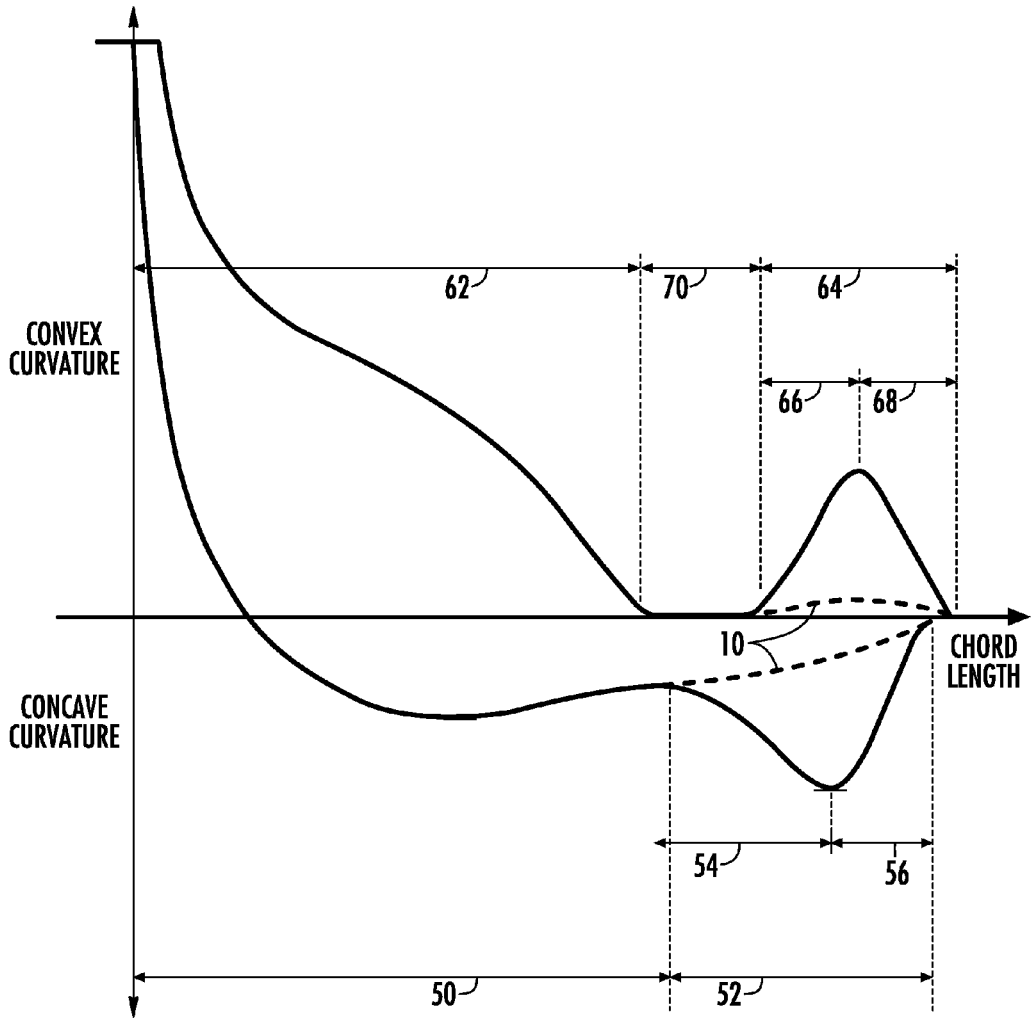
FIG. 5 is an exemplary graph of the curvature of the airfoil shown in FIG. 4.

FIG. 4 provides a radial cross-section view the airfoil 40 according to a second embodiment of the present invention, and FIG. 5 provides an exemplary graph of the curvature of the airfoil 40 shown in FIG. 4. The airfoil 40 generally includes the same contours for the pressure and suction surfaces 46, 48 as previously described with respect to FIGS. 2 and 3. In addition, the suction surface 48 includes an intermediate section 70 between the first convex section 62 and the second convex section 64. The intermediate section 70 may commence near a throat 72 on the suction surface 48 and extend downstream toward the second convex section 64 with a curvature of zero.

One of ordinary skill in the art will readily appreciate from the teachings herein that the magnitude and/or length of the particular concave, convex, and intermediate sections will vary according to particular embodiments and placement in the turbine, and the present invention is not limited to any specific magnitudes or lengths unless specifically recited in the claims. The additional curvature provided by the second concave and/or convex sections 52, 64 previously described and shown in FIGS. 2-5 may begin and end at any point along the radial span of the airfoil 40 to produce a larger unguided turning angle compared to the exemplary airfoil 10 shown in FIG. 1. Computational fluid dynamic calculations indicate that the localized increase in the unguided turning angle near the trailing edge 18 shown in FIGS. 2-5 will effectively dampen or flatten the magnitude of the shock waves emanating from the pressure side 12 of the adjacent airfoil 40 along the chord line of the airfoil 40. As a result, the efficiency of the airfoil 40 at lower flow rates, or part load, is increased.

The various embodiments shown and described with respect to FIGS. 2-5 may be incorporated into new turbine designs or incorporated into existing turbine designs during planned or unplanned outages to reduce shock losses and/or increase turbine efficiency. For example, for existing turbine designs, conventional airfoils 10 may be removed and replaced with the airfoils 40 having second concave and/or convex sections 52, 64, as shown in FIG. 2 or 4. The location, length, and amount of the unguided turning angle may be specifically tailored according to the particular location and anticipated environmental conditions for the turbine being modified.

This written description uses examples to disclose the invention, including the best mode, and also to enable any person skilled in the art to practice the invention, including making and using any systems or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An airfoil comprising:

a. a leading edge;

b. a trailing edge downstream from the leading edge;

c. a pressure surface between the leading and trailing edges;

d. a suction surface between the leading and trailing edges and opposite the pressure surface;

e. a first convex section on the suction surface, wherein the first convex section decreases in curvature downstream from the leading edge;

f. a throat on the suction surface downstream from the first convex section;

g. a second convex section on the suction surface downstream from the throat;

h. a first convex segment of the second convex section, wherein the first convex segment of the second convex section increases in curvature; and i. a first concave section on the pressure surface and a second concave section on the pressure surface downstream from the first concave section, wherein the first concave section increases in curvature downstream from the leading edge and the second concave section increases in curvature downstream from the first concave section.

2. The airfoil as in claim 1, wherein the first convex section continuously decreases in curvature downstream from the leading edge.

3. The airfoil as in claim 1, further comprising an intermediate section between the first convex section and the second convex section, wherein the intermediate section has a curvature of zero.

4. The airfoil as in claim 1, further comprising a second convex segment of the second convex section downstream from the first convex segment, wherein the second convex segment decreases in curvature.

5. The airfoil as in claim 1, wherein the second concave section has a larger maximum curvature than the first concave section.

6. The airfoil as in claim 1, wherein the second concave section includes a first concave segment that increases in curvature and a second concave segment downstream from the first concave segment that decreases in curvature.

7. An airfoil comprising:

a. a leading edge;

b. a trailing edge downstream from the leading edge;

c. a pressure surface between the leading and trailing edges;

d. a suction surface between the leading and trailing edges and opposite the pressure surface;

e. a first concave section on the pressure surface, wherein the first concave section increases in curvature downstream from the leading edge;

f. a second concave section on the pressure surface downstream from the first concave section;

g. a first concave segment of the second concave section, wherein the first concave segment of the second concave section increases in curvature; and h. wherein the second concave section has a larger maximum curvature than the first concave section.

8. The airfoil as in claim 7, further comprising a second concave segment downstream from the first concave segment that decreases in curvature.

9. The airfoil as in claim 7, further comprising a first convex section on the suction surface, a throat on the suction surface downstream from the first convex section, and a second convex section on the suction surface downstream from the throat, wherein the first convex section decreases in curvature downstream from the leading edge and the second convex section increases in curvature downstream from the throat.

10. The airfoil as in claim 9, wherein the first convex section continuously decreases in curvature downstream from the leading edge.

11. The airfoil as in claim 9, further comprising an intermediate section between the first convex section and the second convex section, wherein the intermediate section has a curvature of zero.

12. The airfoil as in claim 9, wherein the second convex section includes a first convex segment that increases in curvature and a second convex segment downstream from the first convex segment that decreases in curvature.

13. An airfoil comprising:

a. a leading edge;

b. a trailing edge downstream from the leading edge;

c. a pressure surface between the leading and trailing edges;

d. a first concave section on the pressure surface, wherein the first concave section increases in curvature downstream from the leading edge;

e. a second concave section on the pressure surface downstream from the first concave section;

f. a first concave segment of the second concave section, wherein the first concave segment of the second concave section increases in curvature;

g. a suction surface between the leading and trailing edges and opposite the pressure surface;

h. a first convex section on the suction surface, wherein the first convex section decreases in curvature downstream from the leading edge;

i. a throat on the suction surface downstream from the first convex section;

j. a second convex section on the suction surface downstream from the throat; and k. a first convex segment of the second convex section, wherein the first convex segment of the second convex section increases in curvature.

14. The airfoil as in claim 13, wherein the first convex section continuously decreases in curvature downstream from the leading edge.

15. The airfoil as in claim 13, further comprising an intermediate section between the first convex section and the second convex section, wherein the intermediate section has a curvature of zero.

16. The airfoil as in claim 13, further comprising a second convex segment of the second convex section downstream from the first convex segment, wherein the second convex segment decreases in curvature.

17. The airfoil as in claim 13, wherein the second concave section has a larger maximum curvature than the first concave section.

18. The airfoil as in claim 13, wherein the second concave section includes the first concave segment that increases in curvature and a second concave segment downstream from the first concave segment that decreases in curvature.

* * * * *